US007278352B2

(12) United States Patent
Füllgraf et al.

(10) Patent No.: US 7,278,352 B2
(45) Date of Patent: Oct. 9, 2007

(54) PRINTING BLANKET ASSEMBLY AND METHOD FOR PRODUCING SAID PRINTING BLANKET ASSEMBLY

(75) Inventors: Stefan Füllgraf, Duderstadt (DE); Andreas Kümmet, Würzburg (DE); Manfred Liebler, Erlenbach (DE); Martin Schoeps, Güntersleben (DE)

(73) Assignees: ContiTech Elastomer-Beschichtungen GmbH, Northeim (DE); Koenig & Bauer Aktiengesellschaft, Würzburg (DE)

( * ) Notice: Subject to any disclaimer, the term of this patent is extended or adjusted under 35 U.S.C. 154(b) by 0 days.

(21) Appl. No.: 10/538,798

(22) PCT Filed: Dec. 15, 2003

(86) PCT No.: PCT/DE03/04290

§ 371 (c)(1),
(2), (4) Date: Dec. 28, 2005

(87) PCT Pub. No.: WO2004/054809

PCT Pub. Date: Jul. 1, 2004

(65) Prior Publication Data

US 2006/0124006 A1 Jun. 15, 2006

(30) Foreign Application Priority Data

Dec. 16, 2002 (DE) ..... 102 58 975
Feb. 21, 2003 (DE) ..... 103 07 382
Feb. 21, 2003 (DE) ..... 103 07 383

(51) Int. Cl.
*B41F 13/00* (2006.01)

(52) U.S. Cl. ..... 101/401; 101/415.1; 101/493

(58) Field of Classification Search ..... None
See application file for complete search history.

(56) References Cited

U.S. PATENT DOCUMENTS 2,714,852 A * 8/1955 Stempel ..... 101/415.1

(Continued)

FOREIGN PATENT DOCUMENTS

DE 4307320 3/1993
DE 19521645 6/1995

(Continued)

*Primary Examiner*—Jill E. Culler
(74) *Attorney, Agent, or Firm*—Whitham Curtis Christofferson & Cook, PC

(57) ABSTRACT

The invention relates to a printing blanket assembly for a blanket cylinder of a rotary printing press. The printing blanket assembly comprises a dimensionally stable support plate (02, 18) with two ends, one of which is the forward end and the other one is the trailing end with respect to the rotation of the blanket cylinder, these ends being fastened to the blanket cylinder with folded, printing-blanket free limbs (21, 22). The assembly further comprises a printing blanket (03, 19), fastened to the outside of the support plate (02, 18) and having a forward end (12, 31) and a trailing end (11, 32). Said printing blanket assembly allows for perfect printing also in the area of a gap between the limbs (21, 22) and can be produced in a simple manner. For this purpose, both ends (11, 12; 31, 32) of the printing blanket (03, 19) project beyond the bevelled edge (08, 09; 27, 28) of the pertaining limbs (04, 06; 21, 22) of the support plate (02, 18) and one support element (13, 14; 34, 36) for supporting said projection is disposed between the bevelled edge (08, 09; 27, 28) and the inside of the printing blanket (03, 19).

16 Claims, 2 Drawing Sheets

U.S. PATENT DOCUMENTS

Figure 1:
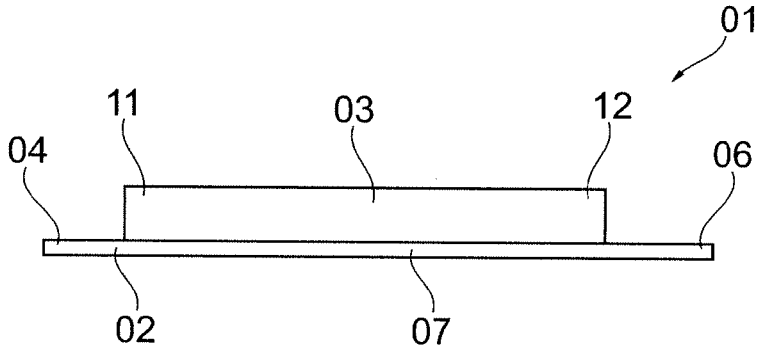

| | | | | | |
|---|---|---|---|---|---|
| 4,515,375 | A | * | 5/1985 | Bleckmann et al. | 277/316 |
| 4,742,769 | A | * | 5/1988 | Zeller | 101/216 |
| 5,178,068 | A | * | 1/1993 | Junghans et al. | 101/415.1 |
| 5,669,306 | A | * | 9/1997 | Puschnerat | 101/415.1 |
| 6,073,558 | A | * | 6/2000 | Jones | 101/415.1 |

FOREIGN PATENT DOCUMENTS

| | | |
|---|---|---|
| DE | 19543584 | 11/1995 |
| DE | 195 47917 | 12/1995 |
| FR | 1367860 | 6/1964 |

* cited by examiner

PRINTING BLANKET ASSEMBLY AND METHOD FOR PRODUCING SAID PRINTING BLANKET ASSEMBLY

The invention relates to a printing blanket assembly for a printing blanket cylinder of a rotary press, having a dimensionally stable carrier plate with two ends, of which one forms a leading end and the other forms a trailing end with respect to the rotation of the printing blanket cylinder, and which can be fixed to the printing blanket cylinder by turned-over limbs that are free of the printing blanket, and having a printing blanket fixed to the outside of the carrier plate and having a leading end and a trailing end.

The invention further relates to a method for producing such a printing blanket assembly.

Printing blanket assemblies of this type in rotary presses are fixed to the printing blanket cylinder and, in offset printing, are used to transfer the printing image from the plate cylinder to the printing material web. In order to impart the necessary mechanical strength to the printing blanket assembly, a carrier plate, for example of sheet steel, is used. A printing blanket, which can be built up with one or more rubber layers, is fixed to the outer side of the carrier plate. In order to fix the printing blanket assembly on the printing blanket cylinder, turned-over limbs free of the printing blanket are provided at the leading end and at the trailing end of the carrier plate with respect to the direction of rotation of the printing blanket cylinder. These limbs can then be inserted, for example, into a slot provided on the printing blanket cylinder and can be fixed there.

One problem in the case of known printing blanket assemblies is that the printing blanket does not enclose the carrier plate seamlessly, instead a gap remains between the leading and the trailing end of the printing blanket. In the region of this gap, no printing ink can be transferred to the printing material web. At the edges of the printing blanket to the gaps, in addition the printed image is of poorer quality. Furthermore, the gap constitutes a vibration source, since a drop in the pressing forces occurs in the region of the gap. Because of the periodic pressure fluctuations, stripes can arise in the printed image. The prior art therefore discloses various solutions with which the disadvantages brought about by the gap between the ends of the printing blanket are intended to be avoided.

DE 195 47 917 A1 discloses a printing blanket assembly in which the two ends of the printing blanket used overlap each other with a form fit, in order as a result to reduce the gap between the ends of the printing blanket.

DE 195 21 645 A1 discloses a printing blanket assembly in which a slide is arranged between the two limbs of the carrier plate. The outwardly pointing end of the slide is in this case connected to a filler, so that the gap between the ends of the printing blanket is closed by the filler.

DE 195 43 584 C1 discloses a printing blanket assembly in which the printing blanket is assembled from a large number of layers. The top layer in this case covers the end faces of the layers located underneath and, in this way, forms a projection, by means of which the gap between the ends is reduced.

A printing blanket assembly of the type mentioned at the beginning is disclosed by U.S. Pat. No. 4,635,550. In order to support the printing blanket in the region of the gap of the printing blanket cylinder, the end of the carrier plate that is connected to a tensioning apparatus is provided with a supporting element which, on the upper side, is intended to have a curvature which continues the peripheral curvature of the printing blanket cylinder with the carrier plate tensioned thereon in the region of the gap and bridges the gap. The printing blanket is then fitted to this arrangement, a spacer channel between the ends of the printing blanket being arranged outside the gap but adjacent to the gap, in order to be able to take the printing blanket assembly off the cylinder. The disadvantage of this solution is the necessary high fabrication accuracy for the shaping of the supporting element, since this is intended to continue the curvature of the peripheral surface of the printing blanket cylinder and must be designed to be so large that it fills the entire gap and is supported on the turned-over edge of the other end (the leading end) of the carrier plate in a predetermined position. A fabrication accuracy of this type in practice leads to considerable implementation problems.

The invention is therefore based on the object of providing a printing blanket assembly of the type mentioned at the beginning which permits the effective gap of the printing blanket cylinder to be reduced with means which are simple to fabricate.

According to the invention, in order to achieve this object, a printing blanket assembly of the type mentioned that the beginning is characterized in that both ends of the printing blanket project beyond the turned-over edge of the associated limb of the carrrier plate, and in that in each case a supporting element for supporting the projection is arranged between the turned-over edge and the inner side of the printing blanket.

In the printing blanket assembly according to the invention, both ends of the printing blanket project beyond the turned-over edges of the associated limb. As a result of this projection, the gap between the ends of the printing blanket is reduced. In this case it is possible for the projection to be chosen to be so large that the two ends of the printing blanket come to lie close to or just on in each other in the installed position. In order to support the projecting ends of the printing blanket from below, at least to a certain extent, the supporting elements are provided under both ends of the printing blanket in order to support the projection. As a result, the printing forces are then transferred from the printing blanket via the supporting element to the carrier plate, so that the printed image can be printed onto the printing material web satisfactorily even in the region of the two projecting ends of the printing blanket. Many and various possible solutions are conceivable for fixing the supporting elements to the printing blanket assembly. In a preferred embodiment, the supporting elements are fixed to the turned-over edge and/or to the inner side of the printing blanket by a material connection, in particular firmly adhesively bonded or vulcanized on.

In a preferred embodiment, the supporting elements fill up the interspace between the turned-over edge and the projection of the printing blanket.

The supporting elements are preferably formed from a shapeable, curing material, in particular from a vulcanized rubber compound or from a cured plastic compound. A suitable plastic is polyurethane which, in the cured state, exhibits a thermosetting behavior.

In a preferred embodiment, the printing blanket assembly is formed by the material of the printing blanket being applied to the carrier plate, ends of the carrier plate that are free of the printing blanket then being turned over at the edge in order to form the limbs in such a way that the ends of the printing blanket project beyond the turned-over edges and in each case a supporting element being introduced into the interspaces between printing blanket and carrier plate formed by the turned-over edges, the supporting element naturally extending over the entire working width of the printing blanket.

An expedient production method provides for the material of the printing blanket to be applied to the carrier plate in not yet cured form and for the supporting elements to be formed from a curable material, in particular rubber. In this case, the printing blanket can cure together with the supporting elements, in particular by means of vulcanization.

In another embodiment of the invention, the mutually facing side surfaces of the supporting element are designed to have shapes complementary to each other following the mounting of the printing assembly and to rest on each other or form only a small gap. In a corresponding way, the mutually facing side surfaces of the mutually opposite ends of the printing blanket can also be designed to have complementary shapes following the mounting of the printing blanket assembly and to come to lie on each other or form only a small gap. This is achieved in that the supporting elements are formed from a supporting material put into the gap, by dividing the supporting material.

In this case, it is conceivable for the supporting elements to be connected by a material connection to a foundation layer, which is arranged between printing blanket and carrier plate, and in this way to wrap continuously around the carrier plate, starting from the two turned-over edges. As a result of the foundation layer, the properties of the printing blanket assembly, in particular with regard to hardness and circularity, can additionally be influenced. In particular, rubber or a similar elastomer material is suitable as a material for producing the foundation layer.

For the fabrication method in the further embodiment, a fabrication cylinder must be available, of which the shape, in particular the diameter and the fixing devices for fixing the carrier plate, correspondent substantially to the printing blanket cylinder subsequently used in the press. On this fabrication cylinder, the uncoated carrier plate is fixed by the turned-over limbs and, in this way, assumes a position which corresponds to the subsequent position following mounting on the printing blanket cylinder.

After the carrier plate has been fixed to the fabrication cylinder, the gap between the opposite turned-over edges of the carrier plate is filled with a supporting material, for example with a curable rubber compound. In this way, the two turned-over edges of the carrier plate are connected to each other by a material connection. Following that, the printing blanket is fixed to the carrier plate, for example adhesively bonded or vulcanized on, in such a way that the ends of the printing blanket project beyond the turned-over edge of the associated limb. In this way, the projection then lies on the supporting material in a manner supported from below.

In order to be able to take the printing blanket assembly off the fabrication cylinder, the supporting material is severed, forming two supporting elements, before or after the printing blanket is fixed to the carrier plate. This can be done, for example, by the supporting element being cut through with a sharp cutter. The two side surfaces of the mutually opposite supporting elements formed by the dividing method in this way have complimentary shapes, so that, after the printing blanket assembly has been mounted on the printing blanket cylinder, the supporting elements come to lie at a short distance from each other or just in contact with each other with complementary shapes.

In order not only to be able to ensure optimum support of the projection at the end of the printing blanket but also to minimize or to eliminate the gap between the two ends of the printing blanket, another method variant is used. In this method variant, the usual printing blankets are used which, before the printing blanket is fitted to the carrier plate, have a flat shape, for example a rectangular shape. As a result of fitting the printing blanket to the carrier plate, when using these flat printing blankets, a gap is formed between the mutually facing side surfaces and the mutually opposite ends of the printing blanket. This gap can be filled up with a suitable sealing material, for example a curable rubber compound. In order to be able to take the printing blanket assembly off the fabrication cylinder, the sealing material is then the severed after adequate curing. The side surfaces of the mutually opposite ends of the printing blanket formed by the dividing method have complementary shapes as a result, so that, after the printing blanket assembly has been mounted on the printing blanket cylinder, the ends of the printing blanket come to lie opposite each other at a short distance or in contact with each other with complimentary shapes.

In order to achieve the most accurate circularity, it is particularly advantageous if, before or after being severed, the sealing material is machined, for example ground, forming a cylindrical peripheral surface.

Sealing material and supporting material are preferably severed at the same time, in order to ensure an optimum form fit between the mutually opposite ends of the printing blanket assembly when the printing blanket assembly is mounted on the printing blanket cylinder.

As an alternative to using flat printing blankets, the use of tubular printing blankets is also conceivable. On account of the tubular shape, the joining of the ends, such as is required in the case of flat printing blankets in the method variant described in order to eliminate the gap between the ends of the printing blanket, is omitted in the case of these tubular blankets. In order to fix the tubular printing blankets, it is, for example, conceivable for a suitable adhesive to be forced into the gap between printing blanket and carrier plate after the printing blanket has been arranged on the carrier plate. To this end, channels or cutouts can be provided on the carrier plate. As an alternative to this, the use of adhesive compounds that can be cured by temperature or irradiation with light is conceivable, so that the tubular printing blankets can first be pulled onto the carrier plate and then the adhesive applied to the carrier plate is cured by increasing the temperature or by irradiating with light. As soon as the tubular printing blanket has been fixed to the carrier plate, it can be severed by suitable dividing methods, in order to be able to take the carrier plate off the fabrication cylinder. This division can also be performed jointly with the division of the supporting material.

Figure 2:
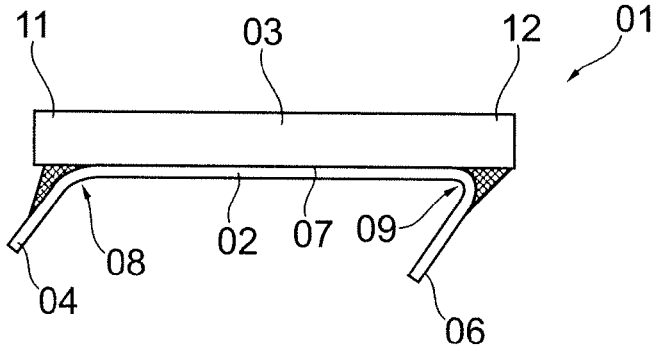
Figure 3:
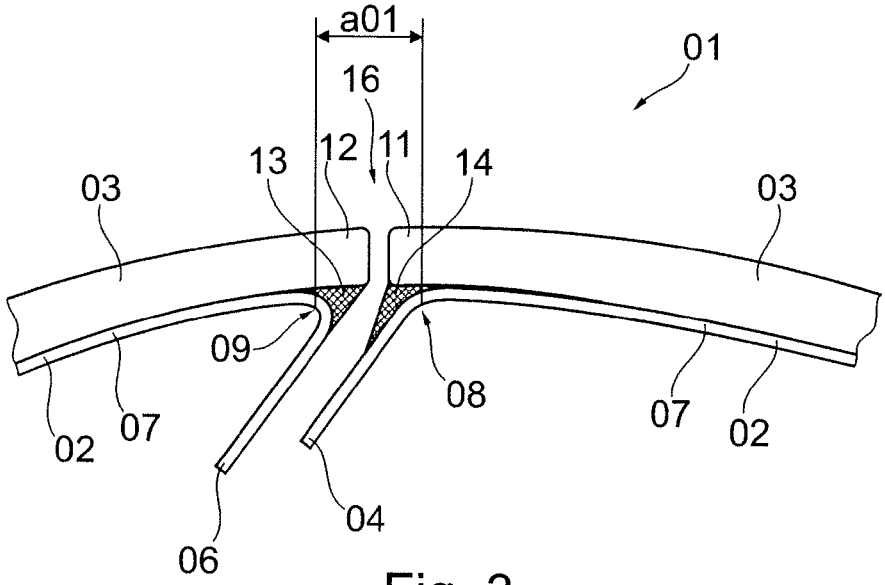
Figure 4:
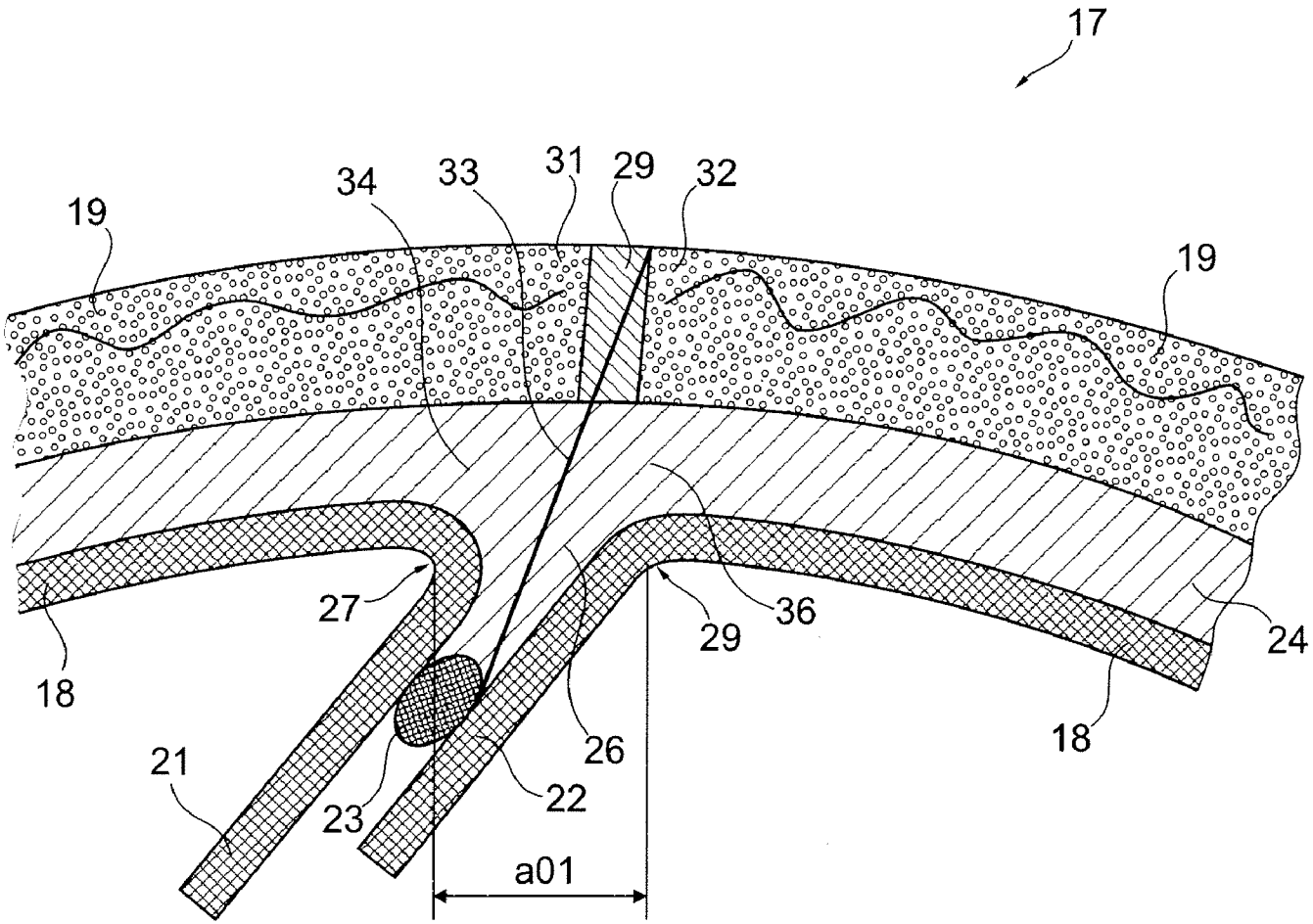

Two embodiments of the invention are illustrated schematically in the drawings; and will be described by way of example below. In the drawings:

FIG. 1 shows a first embodiment of a printing blanket assembly in a first fabrication phase FIG. 2 shows the printing blanket assembly according to FIG. 1 in a second fabrication phase FIG. 3 shows the printing blanket assembly according to FIG. 1 and FIG. 2 in a third fabrication phase FIG. 4 shows a second embodiment of a printing blanket unit in a partial cross section.

The printing blanket assembly 01 illustrated in FIGS. 1 to 3, the thickness of which is, for example, 1.9 mm, comprises a carrier plate 02 having a thickness of about 0.2 mm to 0.5 mm, and a printing blanket 03 fixed to the carrier plate 02. The carrier plate 02 can be produced, for example, from a steel sheet. The printing blanket 03 can be formed, for example, in the manner of a rubber blanket, in particular from a plurality of layers of different material.

In the fabrication phase illustrated in FIG. 1, both the carrier plate 02 and the printing blanket 03 are designed to be completely flat, so that the printing blanket 03 can be fixed to the carrier plate 02 without any tension or deformation. For this purpose, the printing blanket 03 can, for example, be adhesively bonded on or vulcanized on.

Then, in an edge-turning machine, the limbs 04 and 06 that are free of the printing blanket at the leading and at the trailing end of the carrier plate 02 are turned over downward at the edge, so that the limbs 04 and 06 can subsequently be used for fixing the printing blanket assembly 01 to a printing blanket cylinder, not illustrated. Between the limbs 04 and 06 there runs the still flat central part 07 of the carrier plate 02, which is completely covered with respect to the outside by the printing blanket 03. The turned-over edges 08 and 09 run at the transition between the central part 07, on the one hand, and the limbs 04 and 06, on the other hand.

The turned-over edges 08 and 09 are produced in the edge-turning machine in such a way that the two ends 11 and 12 of the printing banking 03 project slightly beyond the turned-over edges 08 and 09. The interspace between the projecting ends 11 and 12, on one hand, and the carrier plate 02, on the other hand, is filled by two supporting elements 13 and 14. The supporting elements 13 and 14 can be produced, for example, by applying a curable rubber compound.

A detail of the printing blanket assembly 01 in the installed position is illustrated in FIG. 3. It can be seen that that the two limbs 04 and 06 run parallel and opposite to each other in the installed position, so they can be fixed jointly in a slot in a printing cylinder, not illustrated. Because of the projection of the ends 11 and 12 of the printing blanket 03, the width of the gap 16 between the ends 11 and 12 of the printing blanket 03 is minimized. As a result, it is possible, for example, to minimize the width of the gap 16 to a width of less than 0.5 mm.

The distance between the limbs 04 and 06 substantially corresponds to the spacing a01 of the opening on the cylinder surface and is less than 3 mm, in particular it is less than 1.5 mm.

Because of the support of the projecting ends 11 and 12 by the supporting elements 13 and 14, an adequate transfer of print from the printing blankets 03 to a printing material web is achieved in this region.

A second embodiment of a printing blanket assembly 17 according to the invention is illustrated in FIG. 4. The printing blanket unit 17 also has a carrier plate 18 made of steel sheet and a printing blanket 19 made of rubber. In order to produce the printing blanket assembly 17, first of all the carrier plate 18 is fixed by its limbs 21 and 22 to a fabrication cylinder, the shape of which corresponds to the printing blanket cylinder to which the printing blanket assembly 17 is to be fixed in the press. A seal element 23 is then inserted into the gap 26 between the limbs 21 and 22 in order to seal off the gap 26 at the bottom. After that, a liquid elastomer compound is applied to the outer side of the carrier plate 18 in such a way that the carrier plate 18 is surrounded by a continuous foundation layer 24. In the region of the opposing limbs 21 and 22, the foundation layer 24 fills up the gap 26 between the opposing turned-over edges 27 and 28.

The printing blanket 19 is then fixed to the foundation layer 24, for example vulcanized on. The gap 26, which continues between the ends 31 and 32 of the printing blanket 19, is closed with sealing material 29, for example a curable elastomer compound, and is then ground on the outer side in order to produce a uniformly cylindrical outer surface.

Finally, the sealing material 29 and the foundation layer 24 are severed along the cut line 33, so that the printing blanket unit 17 can be taken off the fabrication cylinder and mounted on a printing blanket cylinder. As a result of the division of the foundation layer 24, separate supporting elements 34 and 36 are formed, which each support the ends 31 and 32 of the printing blanket 19 from below. When the printing blanket assembly 17 is mounted on a printing blanket cylinder, the side surfaces of the supporting elements 34 and 36 formed by the cut along the cut line 33 come into contact with each other with a form fit.

The invention claimed is:

1. A printing blanket assembly for a printing blanket cylinder of a rotary press, having a dimensionally stable carrier plate with two ends, of which one forms a leading end and the other forms a trailing end with respect to the rotation of the printing blanket cylinder, and which can be fixed to the printing blanket cylinder by turned-over limbs that are free of the printing blanket, and having a printing blanket fixed to the outside of the carrier plate and having a leading end and a trailing end, wherein said leading end and said trailing end of the printing blanket each project beyond a turned-over edge of an associated limb of said turned-over limbs of the carrier plate, and two supporting elements each of which is arranged between a turned-over edge of an associated limb of said turned-over limbs and an inner side of the printing blanket and supports a projection of the printing blanket.

2. The printing blanket assembly as claimed in claim 1, wherein the two supporting elements fill up the interspaces between the turned-over edge and the projection of the printing blanket.

3. The printing blanket assembly as claimed in claim 1, wherein each of said two supporting elements are formed form a vulcanized rubber compound or a cured plastic compound.

4. The printing blanket assembly as claimed in claim 1, wherein mutually facing side surfaces of two mutually facing supporting elements are designed to have shapes complementary to each other following the mounting of the printing blanket assembly on the printing blanket cylinder and to virtually or just rest on each other.

5. The printing blanket assembly as claimed in claim 4, wherein the two supporting elements are produced from one work piece by a dividing fabrication method, forming the mutually facing side surfaces.

6. The printing blanket assembly as claimed claim 1, wherein mutually facing side surfaces of the printing blanket at mutually opposite ends are designed to have shapes complementary to each other following the mounting of the printing assembly on the printing blanket cylinder and to virtually or just rest on each other.

7. The printing blanket assembly as claimed in claim 6, wherein said mutually opposite of the printing blanket are produced from one workpiece by a dividing fabrication method, forming the mutually facing side surfaces.

8. A method for producing a printing blanket assembly as claimed in claim 1, characterized by the following methods steps:

a material of the printing blanket is applied to the carrier plate, ends of the carrier plate that are free of the printing blanket are turned over at the edge in order to form the limbs in such a way that the ends of the printing blanket project beyond the turned-over edges, and two supporting element are introduced into the interspaces between printing blanket and carrier plate formed by each of the turned-over edges.

9. A method for producing a printing blanket assembly as claimed in claim 1, characterized by the following method steps:

an uncoated carrier plate is fixed by the turned-over limbs to a fabrication cylinder, a shape of which corresponds to the printing blanket cylinder, a gap between the opposite turned-over ends of the carrier plate is filled with a supporting material, the printing blanket is fixed to the carrier plate in such a way that the leading and the trailing end of the printing blanket project with an inner side beyond the turned-over edge of the associated limb, before or after the printing blanket is fixed to a carrier plate, the supporting material is severed, forming two supporting elements, and the carrier plate is taken off the fabrication cylinder.

10. The method as claimed in claim 9, wherein before the printing blanket is fitted to the carrier plate, the printing blanket has a flat shape and, after the printing blanket has been fitted to the carrier plate, the gap between mutually facing side surfaces at mutually opposite ends of the printing blanket is filled with sealing material, the sealing material being severed in order to take the printing blanket assembly off the fabrication cylinder.

11. The method as claimed in claim 10, wherein before or after being severed, the sealing material is machined to form a cylindrical peripheral surface.

12. The method as claimed in claim 10, wherein the sealing material is severed at the same time as the supporting material.

13. The method as claimed in claim 9, wherein the printing blanket has a tubular shape before the printing blanket is fitted to the carrier plate.

14. The method as claimed in claim 13, wherein the printing blanket is severed together with the supporting material.

15. The method as claimed in claim 9, wherein before the printing blanket is fixed to the carrier plate, at least one foundation layer is applied to the carrier plate, forming the supporting elements.

16. The method as claimed in claim 15, wherein the foundation layer and the supporting material are formed simultaneously on the carrier plate by using a uniform material.

* * * * *